United States Patent [19]

Branovich et al.

[11] Patent Number: 4,895,699

[45] Date of Patent: Jan. 23, 1990

[54] METHOD OF MAKING A CATHODE FROM TUNGSTEN AND IRIDIUM POWDERS USING A REACTION PRODUCT FROM REACTING BARIUM PEROXIDE WITH AN EXCESS OF TUNGSTEN AS THE IMPREGNANT

[75] Inventors: Louis E. Branovich, Howell; Gerard L. Freeman, Freehold; Bernard Smith, Ocean; Donald W. Eckart, Wall, all of N.J.

[73] Assignee: The United States of America as represented by the Secretary of the Army, Washington, D.C.

[21] Appl. No.: 401,202

[22] Filed: Aug. 24, 1989

[51] Int. Cl.[4] ..... B22F 3/26

[52] U.S. Cl. ..... 419/27; 419/26; 419/29; 419/33; 419/39; 419/54; 419/55; 419/58

[58] Field of Search ..... 419/33, 39, 58, 26, 419/27, 29, 54, 55

[56] References Cited

U.S. PATENT DOCUMENTS

| | | | |
|---|---|---|---|
| 4,444,718 | 4/1984 | Smith et al. | 419/37 |
| 4,818,480 | 4/1989 | Branovich et al. | 419/27 |
| 4,840,767 | 6/1989 | Branovich et al. | 419/27 |

*Primary Examiner*—Stephen J. Lechert, Jr.
*Attorney, Agent, or Firm*—Michael Zelenka; Roy E. Gordon

[57] ABSTRACT

A cathode is made from a mixture of tungsten and iridium powders using a reaction product formed from reacting barium peroxide with an excess of tungsten as the impregnant.

6 Claims, No Drawings

METHOD OF MAKING A CATHODE FROM TUNGSTEN AND IRIDIUM POWDERS USING A REACTION PRODUCT FROM REACTING BARIUM PEROXIDE WITH AN EXCESS OF TUNGSTEN AS THE IMPREGNANT

The invention described herein may be manufactured, used and licensed by or for the Government for governmental purposes without the payment to us of any royalties thereon.

This invention relates in general to a method of making a long life high current density cathode and in particular, to a method of making such a cathode by mixing tungsten and iridium powders to form a porous billet and using a reaction product formed from reacting barium peroxide with an excess of tungsten as an impregnant for the porous billet.

BACKGROUND OF THE INVENTION

In U.S. Pat. No. 4,818,480, issued Apr. 4, 1989 to L. E. Branovich et al, there is disclosed and claimed a method of making a long life high density cathode from a mixture of tungsten and iridium powders that uses as the impregnant barium peroxide alone, or a mixture of barium peroxide with iridium, or a mixture of barium peroxide with osmium, or a mixture of barium peroxide with rhodium. Also, in U.S. Pat. No. 4,840,767, issued June 20, 1989 to L. E. Branovich et al, there is described and claimed a method of making a long life high current density cathode from a mixture of tungsten and iridium powders using a barium iridiate formed from barium peroxide and iridium oxide as the impregnant. Although desirable in many aspects, the difficulty with the method of the inventions in these patents is that the chemical reaction is not sufficiently rapid and the resulting emission over a set time period is not sufficient.

The general object of this invention is to provide an improved method of making a long life high current density cathode. A more particular object of the invention is to provide such a method that will be rapid and in which the resulting emission over a set time period will be sufficient.

It has now been found that such a method can be provided by making such a cathode from a mixture of tungsten and iridium powders to form a porous billet and using a reaction product formed from reacting barium peroxide with an excess of tungsten as the impregnant for the porous billet.

By an excess of tungsten is meant that the molar ratio of barium peroxide to tungsten in forming the impregnant is less than 3 to 1. This is because in a 3:1 molar ratio of $BaO_2$ to W, the resulting product formed is barium tungstate, $Ba_3WO_6$ according to the reaction:

$$3BaO_2 + W \rightarrow Ba_3WO_6$$

If an excess of tungsten as for example an 0.1 molar excess of tungsten is added to the reactants, the resulting product is $Ba_3WO_6$ with excess tungsten dispersed throughout the impregnant. Since the impregnant must react with the wall of the porous billet that is composed of tungsten or tungsten/iridium, the amount of surface area in the 3:1 molar $BaO_2$/W with 0.1 molar excess of tungsten is increased giving greater surface to surface contact of the impregnant to react with the tungsten within the impregnant as well as with the wall of the porous tungsten or tungsten/iridium impregnated billet.

Therefore, a faster chemical reaction occures and there is greater emission over a set period of time.

A small amount of iridium may also be included in the impregnant. This may be about the same amount as the excess of tungsten included in the impregnant. Osmium or rhodium can be substituted in lieu of iridium. Moreover, it is also within the scope of the invention to substitute molybdenum or aluminum for part or all of the tungsten in the impregnant. It is also important that the average particle size of the impregnant powders be smaller than the average pore size of the billet.

DESCRIPTION OF THE PREFERRED EMBODIMENT

A long life high current density cathode is made in the following manner. Tungsten and iridium powders are mixed in a weight ratio of about 61 weight percent tungsten to about 38 weight percent iridium. 1 weight percent of zirconium hydride activator is added to the mixture and the mixture ball milled for about 8 hours. The ball milled mixture is then pressed into a billet at about 48,000 psi in a die and the billet then sintered at 1800° C. for thirty minutes in dry hydrogen of less than −100 dewpoint. The billet is then backfilled with copper in dry hydrogen at 1500° C., the billet machined to the desired geometry, and the copper then removed by etching in nitric acid. The porous billet is then thoroughly rinsed in deionized water, methanol and then dried. The billet is then impregnated with the reaction product obtained by reacting barium peroxide with an excess of tungsten in the molar ratio of less than 3 to 1 with heating to 1050° C. for about two minutes. After the billet is cooled, loose particles of impregnant are removed from the billet using a jeweler's lathe and fine alumina cloth.

The resulting cathode is then mounted in a test vehicle and activated using standard matrix cathode activation procedures.

We wish it to be understood that we do not desire to be limited to the exact details of construction as described for obvious modifications will occur to a person skilled in the art.

What is claimed is:

1. Method of making a cathode for operation in microwave devices from tungsten and iridium powders using a reaction product formed from reacting barium peroxide with an excess of tungsten as an impregnant, said method including the steps of:

(A) mixing the tungsten and iridium powders,
(B) adding about 2 percent by weight of an activator to the mixture,
(C) ball milling the mixture for about 8 hours,
(D) pressing the ball milled mixture into a billet at about 48,000 p.s.i. in a die,
(E) sintering the billet at about 1800° C. for about thirty minutes in dry hydrogen of less than −100 dewpoint,
(F) backfilling the billet with copper in dry hydrogen at about 1500° C.,
(G) machining the billet to the desired geometry,
(H) removing the copper by etching in nitric acid,
(I) thoroughly rinsing in deionized water, methanol and then drying,
(J) firing the billet in dry hydrogen at about 140° C. for about 15 minutes,
(K) impregnating the billet with reaction product formed from reacting barium peroxide with an excess of tungsten by firing the billet in a dry hydrogen furnace at a temperature at which the impregnant melts for about two minutes, (L) removing the billet from the furnace after the furnace is cooled, and (M) removing any loose pieces of impregnant from the billet.

2. Method of making a cathode according to claim 1 wherein in step (A), the tungsten and iridium powders are mixed in a weight ratio of about 61 weight percent tungsten to about 38 weight percent iridium.

3. Method of making a cathode according to claim 1 wherein in step (B), the activator is about 1 weight percent zirconium hydride.

4. Method of making a cathode according to claim 1 wherein in step (K), the molar ratio of the barium peroxide to the tungsten in the impregnant is less than 3 to 1.

5. Method of making a cathode according to claim 4 wherein an amount of iridium about the same as the amount of the excess of tungsten is included in the impregnant.

6. Method of making a cathode for operation in microwave devices from tungsten and iridium powders using a reaction product formed from reacting barium peroxide with an excess of tungsten as an impregnant, said method including the steps of:

(A) mixing the tungsten and iridium powders in the weight ratio of about 61 weight percent tungsten to about 38 weight percent iridium, (B) adding about 1 percent by weight of zirconium hydride to the mixture, (C) ball milling the mixture for about 8 hours, (D) pressing the ball milled mixture into a billet at about 48,000 p.s.i. in a die, (E) sintering the billet at about 1800° C. for about thirty minutes in dry hydrogen of less than −100 dewpoint, (F) backfilling the billet with copper in dry hydrogen at about 1500° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with reaction product formed from reacting barium peroxide with an excess of tungsten wherein the molar ratio of the barium peroxide to the tungsten in the impregnant is less than 3 to 1 by firing the billet in a dry hydrogen furnace at a temperature at which the impregnant melts for about two minutes, (L) removing the billet from the furnace after the furnace is cooled, and (M) removing any loose pieces of impregnant from the billet.

* * * * *